US011585176B2

(12) United States Patent
Hitchcock

(10) Patent No.: US 11,585,176 B2
(45) Date of Patent: Feb. 21, 2023

(54) SEALING CRACKED CEMENT IN A WELLBORE CASING

(71) Applicant: Saudi Arabian Oil Company, Dhahran (SA)

(72) Inventor: Graham Hitchcock, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 51 days.

(21) Appl. No.: 17/209,495

(22) Filed: Mar. 23, 2021

(65) Prior Publication Data

US 2022/0307338 A1 Sep. 29, 2022

(51) Int. Cl.

| | |
|---|---|
| ***E21B 28/00*** | (2006.01) |
| ***E21B 29/10*** | (2006.01) |
| ***E21B 33/14*** | (2006.01) |
| ***E21B 43/11*** | (2006.01) |
| ***E21B 33/138*** | (2006.01) |
| *E21B 23/01* | (2006.01) |

(52) U.S. Cl.

CPC ..... *E21B 28/00* (2013.01); *E21B 29/10* (2013.01); *E21B 33/138* (2013.01); *E21B 33/14* (2013.01); *E21B 43/11* (2013.01); *E21B 23/01* (2013.01)

(58) Field of Classification Search

CPC ..... E21B 28/00; E21B 29/10; E21B 33/138; E21B 33/14; E21B 43/11; E21B 23/01

See application file for complete search history.

(56) References Cited

U.S. PATENT DOCUMENTS

| | | | | |
|---|---|---|---|---|
| 381,374 | A | 4/1888 | Hine | |
| 774,519 | A | 11/1904 | Greenaway | |
| 2,368,424 | A | 1/1945 | Reistle | |
| 2,604,181 | A * | 7/1952 | Basham | E21B 47/09 310/25 |
| 2,667,932 | A * | 2/1954 | Bodine, Jr. | B01J 19/10 166/74 |
| 2,782,857 | A | 2/1957 | Clark et al. | |
| 2,784,787 | A | 3/1957 | Matthews et al. | |
| 2,890,752 | A | 6/1959 | Cron et al. | |

(Continued)

FOREIGN PATENT DOCUMENTS

| | | |
|---|---|---|
| AU | 2013206729 | 4/2015 |
| CN | 104727799 | 6/2015 |

(Continued)

OTHER PUBLICATIONS

"Echo Dissolvable Fracturing Plug," EchoSeries, Dissolvable Fracturing Plugs, Gryphon Oilfield Solutions, Aug. 2018, 1 page.

(Continued)

*Primary Examiner* — D. Andrews

(74) *Attorney, Agent, or Firm* — Fish & Richardson P.C.

(57) ABSTRACT

A method and a tool for sealing cracked casing cement are described. In a wellbore in which a casing is deployed, the casing and the wellbore define an annulus sealed with a casing cement. The method includes vibrating a portion of the casing cement adjacent an outer wall of the casing. The portion of the casing cement includes multiple discrete cracks. Vibrating the casing cement connects the discrete cracks to form a crack network. After vibrating the casing cement to form the crack network, a sealant is injected into the crack network through the casing. The sealant seals the crack network.

18 Claims, 10 Drawing Sheets

(56) References Cited

U.S. PATENT DOCUMENTS 3,026,936 A * 3/1962 Teplitz ..... E21B 43/08 166/299
3,093,192 A 6/1963 Allen
3,228,470 A 1/1966 Papaila
3,244,230 A 4/1966 Sharp
3,285,778 A 11/1966 Hauk
3,369,605 A 2/1968 Donaldson et al.
3,386,514 A 6/1968 Weber
3,497,011 A 2/1970 Weber et al.
3,601,197 A 8/1971 Ayers et al.
3,656,550 A 4/1972 Wagner, Jr. et al.
3,695,356 A 10/1972 Argabright et al.
3,866,682 A 2/1975 Jones et al.
3,882,937 A 5/1975 Robinson
3,937,283 A 2/1976 Blauer et al.
3,980,136 A 9/1976 Plummer et al.
4,044,833 A 8/1977 Volz
4,106,562 A 8/1978 Barnes et al.
4,157,116 A 6/1979 Coulter
4,216,829 A 8/1980 Murphy
4,340,405 A 7/1982 Steyert
4,476,932 A 10/1984 Emery
4,493,875 A 1/1985 Beck et al.
4,532,992 A 8/1985 Coenen et al.
4,660,643 A 4/1987 Perkins
4,705,113 A 11/1987 Perkins
4,836,284 A 6/1989 Tinker
4,846,277 A 7/1989 Khalil et al.
5,018,578 A 5/1991 El Rabaa et al.
5,069,283 A 12/1991 Mack
5,394,339 A 2/1995 Jones
5,394,942 A 3/1995 Catania
5,529,123 A 6/1996 Carpenter et al.
5,604,184 A 2/1997 Ellis et al.
5,613,555 A 3/1997 Sorem et al.
5,912,219 A 6/1999 Carrie et al.
6,032,539 A 3/2000 Liu
6,207,620 B1 3/2001 Gonzalez et al.
6,250,387 B1 6/2001 Carmichael et al.
6,263,970 B1 7/2001 Blanchet
6,347,675 B1 2/2002 Kolle
6,419,730 B1 7/2002 Chavez
6,585,046 B2 7/2003 Neuroth et al.
6,729,409 B1 5/2004 Gupta et al.
6,766,856 B1 7/2004 McGee
6,776,231 B2 8/2004 Allen
6,776,235 B1 8/2004 England
6,883,605 B2 4/2005 Arceneaux et al.
6,988,552 B2 1/2006 Wilson et al.
7,001,872 B2 2/2006 Pyecroft et al.
7,044,220 B2 5/2006 Nguyen et al.
7,063,150 B2 6/2006 Slabaugh et al.
7,096,943 B2 * 8/2006 Hill ..... E21B 43/26 166/308.1
7,134,497 B1 11/2006 Chatteiji et al.
7,210,528 B1 5/2007 Brannon et al.
7,252,146 B2 8/2007 Slabaugh et al.
7,255,169 B2 8/2007 van Batenburg et al.
7,281,580 B2 10/2007 Parker et al.
7,281,581 B2 10/2007 Nyuyen et al.
7,334,635 B2 2/2008 Nguyen
7,334,636 B2 2/2008 Nguyen
7,422,060 B2 9/2008 Hammami et al.
7,424,911 B2 9/2008 McCarthy et al.
7,426,961 B2 9/2008 Stephenson et al.
7,434,623 B2 10/2008 Von Gynz-Rekowski
7,451,812 B2 11/2008 Cooper et al.
7,472,751 B2 1/2009 Brannon et al.
7,516,787 B2 4/2009 Kaminsky
7,571,767 B2 8/2009 Parker et al.
7,581,590 B2 9/2009 Lesko et al.
7,610,962 B2 11/2009 Fowler
7,647,971 B2 1/2010 Kaminsky
7,677,317 B2 3/2010 Wilson
7,735,548 B2 6/2010 Cherewyk
7,767,628 B2 8/2010 Kippie et al.
7,803,740 B2 9/2010 Bicerano et al.
7,918,277 B2 4/2011 Brannon et al.
8,002,038 B2 8/2011 Wilson
8,006,760 B2 8/2011 Fleming et al.
8,066,068 B2 11/2011 Lesko et al.
8,100,190 B2 1/2012 Weaver
8,104,537 B2 1/2012 Kaminsky
8,119,576 B2 2/2012 Reyes et al.
8,127,850 B2 3/2012 Brannon et al.
8,205,675 B2 6/2012 Brannon et al.
8,408,305 B2 4/2013 Brannon et al.
8,490,700 B2 7/2013 Lesko et al.
8,584,755 B2 11/2013 Willberg et al.
8,636,065 B2 1/2014 Lesko et al.
8,727,008 B2 5/2014 Krpec
8,757,259 B2 6/2014 Lesko et al.
8,763,699 B2 7/2014 Medvedev et al.
8,936,083 B2 1/2015 Nguyen
8,985,213 B2 3/2015 Saini et al.
9,080,440 B2 7/2015 Panga et al.
9,085,727 B2 7/2015 Litvinets et al.
9,095,799 B1 8/2015 Packard
9,097,094 B1 8/2015 Frost
9,109,429 B2 8/2015 Xu et al.
9,114,332 B1 8/2015 Liu
9,181,789 B2 11/2015 Nevison
9,328,282 B2 5/2016 Li
9,447,673 B2 9/2016 Medvedev et al.
9,523,268 B2 12/2016 Potapenko et al.
9,670,764 B2 6/2017 Lesko et al.
9,725,639 B2 8/2017 Vo et al.
9,725,645 B2 8/2017 Monastiriotis et al.
9,757,796 B2 9/2017 Sherman et al.
9,777,562 B2 10/2017 Lastra et al.
9,816,365 B2 11/2017 Nguyen et al.
9,845,670 B2 12/2017 Surjaatmadja et al.
9,863,230 B2 1/2018 Litvinets et al.
9,863,231 B2 1/2018 Hull
9,902,898 B2 2/2018 Nelson et al.
9,903,010 B2 2/2018 Doud et al.
9,909,404 B2 3/2018 Hwang et al.
9,945,220 B2 4/2018 Saini et al.
9,976,381 B2 5/2018 Martin et al.
9,995,125 B2 6/2018 Madasu et al.
10,001,769 B2 6/2018 Huang et al.
10,012,054 B2 7/2018 Ciglenec
10,030,495 B2 7/2018 Litvinets et al.
10,047,281 B2 8/2018 Nguyen et al.
10,077,396 B2 9/2018 Nguyen et al.
10,087,364 B2 10/2018 Kaufman et al.
10,100,245 B1 10/2018 Bulekbay et al.
10,208,239 B2 2/2019 Ballard
10,352,125 B2 7/2019 Frazier
10,421,897 B2 9/2019 Skiba et al.
10,450,839 B2 10/2019 Bulekbay et al.
10,508,517 B2 12/2019 Bulekbay et al.
10,550,314 B2 2/2020 Liang et al.
10,655,443 B2 5/2020 Gomma et al.
10,836,956 B2 11/2020 Bulekbay et al.
10,858,578 B2 12/2020 Bulekbay et al.
10,883,042 B2 1/2021 Bulekbay
2002/0043507 A1 4/2002 McCulloch
2003/0132224 A1 * 7/2003 Spencer ..... E21B 33/138 166/60
2004/0173244 A1 9/2004 Strothoff et al.
2005/0097911 A1 5/2005 Revellat
2005/0126784 A1 6/2005 Dalton
2005/0137094 A1 6/2005 Weaver et al.
2005/0194147 A1 9/2005 Metcalf et al.
2006/0035808 A1 2/2006 Ahmed et al.
2006/0073980 A1 4/2006 Brannon et al.
2006/0144619 A1 7/2006 Storm
2007/0012437 A1 1/2007 Clingman et al.
2007/0215355 A1 9/2007 Shapovalov
2008/0135242 A1 6/2008 Lesko
2008/0149329 A1 6/2008 Cooper
2008/0153718 A1 6/2008 Heidenfelder et al.
2008/0223579 A1 9/2008 Goodwin

(56) References Cited

U.S. PATENT DOCUMENTS

| | | | |
|---|---|---|---|
| 2009/0044945 | A1 | 2/2009 | Willberg et al. |
| 2009/0151944 | A1 | 6/2009 | Fuller et al. |
| 2009/0298720 | A1 | 12/2009 | Nguyen et al. |
| 2010/0043823 | A1 | 2/2010 | Lee |
| 2010/0282468 | A1 | 11/2010 | Willberg et al. |
| 2010/0323933 | A1 | 12/2010 | Fuller |
| 2012/0018143 | A1 | 1/2012 | Lembcke |
| 2012/0097392 | A1 | 4/2012 | Reyes et al. |
| 2012/0112546 | A1 | 5/2012 | Culver |
| 2012/0125618 | A1 | 5/2012 | Willberg |
| 2012/0247764 | A1 | 10/2012 | Panga |
| 2012/0305247 | A1 | 12/2012 | Chen et al. |
| 2013/0032549 | A1 | 2/2013 | Brown et al. |
| 2013/0161003 | A1 | 6/2013 | Mikhailovich et al. |
| 2013/0260649 | A1 | 10/2013 | Thomson |
| 2013/0312977 | A1 | 11/2013 | Lembcke |
| 2013/0341027 | A1 | 12/2013 | Xu et al. |
| 2014/0000899 | A1 | 1/2014 | Nevison |
| 2014/0131040 | A9 | 5/2014 | Panga |
| 2014/0144633 | A1 | 5/2014 | Nguyen |
| 2014/0144634 | A1 | 5/2014 | Nguyen |
| 2014/0144635 | A1 | 5/2014 | Nguyen |
| 2014/0290943 | A1 | 10/2014 | Ladva |
| 2014/0296113 | A1 | 10/2014 | Reyes |
| 2014/0352954 | A1 | 12/2014 | Lakhtychkin et al. |
| 2015/0047846 | A1 | 2/2015 | Oort |
| 2015/0071750 | A1 | 3/2015 | Foster |
| 2015/0083420 | A1 | 3/2015 | Gupta et al. |
| 2015/0211346 | A1 | 7/2015 | Potapenko |
| 2015/0259593 | A1 | 9/2015 | Kaufman et al. |
| 2015/0369028 | A1 | 12/2015 | Potapenko |
| 2016/0153274 | A1 | 6/2016 | Hull et al. |
| 2016/0208591 | A1 | 7/2016 | Weaver et al. |
| 2016/0215604 | A1 | 7/2016 | Potapenko et al. |
| 2016/0319189 | A1 | 11/2016 | Dusterhoft |
| 2016/0347994 | A1 | 12/2016 | Purdy et al. |
| 2017/0066962 | A1 | 3/2017 | Ravi et al. |
| 2017/0121593 | A1 | 5/2017 | Pantsurkin |
| 2017/0138190 | A1 | 5/2017 | Elkatatny et al. |
| 2018/0202278 | A1 | 7/2018 | Nelson et al. |
| 2018/0230361 | A1 | 8/2018 | Foster |
| 2018/0244981 | A1 | 8/2018 | Panga et al. |
| 2018/0328156 | A1 | 11/2018 | Slater |
| 2018/0334612 | A1 | 11/2018 | Bulekbay et al. |
| 2019/0055818 | A1 | 2/2019 | Bulekbay |
| 2019/0264095 | A1 | 8/2019 | Qu et al. |
| 2019/0323320 | A1 | 10/2019 | Bulekbay et al. |
| 2019/0345377 | A1 | 11/2019 | Haque et al. |

FOREIGN PATENT DOCUMENTS

| | | |
|---|---|---|
| CN | 102777138 | 1/2016 |
| EP | 306546 | 3/1989 |
| FR | 2920435 | 8/2007 |
| GB | 239998 | 9/1925 |
| GB | 2063840 | 6/1981 |
| WO | WO 1992019838 | 11/1992 |
| WO | WO 2006108161 | 10/2006 |
| WO | WO 2016108161 | 10/2006 |
| WO | WO 2009018536 | 2/2009 |
| WO | WO 2010026553 | 3/2010 |
| WO | WO 2015012818 | 1/2015 |
| WO | WO 2015071750 | 5/2015 |
| WO | WO 2016032578 | 3/2016 |
| WO | WO 2017040553 | 3/2017 |
| WO | WO 2017164878 | 9/2017 |

OTHER PUBLICATIONS

"Terv Alloy Degradable Magnesium Alloys," Terves Engineered Response, Engineered for Enhanced Completion Efficiency, Feb. 2018, 8 pages.

Alipour-Kivi et al, "Automated Liquid Unloading in Low-Pressure Gas Wells Using Intermittent and Distributed Heating of Wellbore Fluid," SPE 100650, Society of Petroleum Engineers (SPE), presented at the SPE Western Regional/AAPG Pacific Section/GSA Cordilleran Section Joint Meeting, 2006, 6 pages.

Ansari et al., "Innovative Planning and Remediation Techniques for Restoring the Well Integrity by Curing High Annulus-B Pressure and Zonal Communications," IPTC-18894-MS, International Petroleum Technology Conference (IPTC), presented at the International Petroleum Technology Conference, Nov. 14-16, 2016, 24 pages.

Barree et al., "Realistic Assessment of Proppant Pack Conductivity for Material Selection," SPE-84306-MS, Society of Petroleum Engineers (SPE), presented at the Annual Technical Conference, Oct. 5-8, 2003, 12 pages.

Clifton, "Modeling of In-Situ Stress Change Due to Cold Fluid Injection," SPE 22107, Society of Petroleum Engineers (SPE), presented at the International Arctic Technology Conference, May 29-31, 1991, 13 pages.

Corona et al., "Novel Washpipe-Free ICD Completion With Dissolvable Material," OTC-28863-MS, Offshore Technology Conference (OTC), presented at the Offshore Technology Conference, Apr. 30-May 3, 2018, 10 pages.

Gil et al., "Wellbore Cooling as a Means to Permanently Increase Fracture Gradient," SPE Annual Technical Conference and Exhibition, San Antonio, Texas, Sep. 24-27, 2006, published Jan. 1, 2006, 9 pages.

Gillard et al., "A New Approach to Generating Fracture Conductivity," SPE-135034-MS, Society of Petroleum Engineers (SPE), presented at the SPE Annual Technical Conference and Exhibition held in Florence, Italy, Sep. 20-22, 2010, 13 pages.

glossary.oilfield.slb.com [online], "Underbalance," retrieved on Apr. 12, 2019, retrieved from URL http://www.glossary.oilfield.slb.com/Terms/u/underbalance.aspx, 1 pages.

Gomaa et al., "Acid Fracturing: The Effect of Formation Strength on Fracture Conductivity," SPE 119623, Society of Petroleum Engineers (SPE), presented at the SPE Hydraulic Fracturing Technology Conference, Jan. 2009, 18 pages.

Gomaa et al., "Computational Fluid Dynamics Applied to Investigate Development and Optimization of Highly Conductive Channels within the Fracture Geometry," SPE-179143-MS, Society of Petroleum Engineers (SPE), presented at the SPE Hydraulic Fracturing Technology Conference, Texas, Feb. 9-11, 2016, 18 pages.

Gomaa et al., "Improving Fracture Conductivity by Developing and Optimizing a Channels Within the Fracture Geometry: CFD Study," SPE-178982-MS, Society of Petroleum Engineers (SPE), presented at the SPE International conference on Formation Damage Control in Layfayette, Feb. 24-26, 2016, 25 pages.

hub.globalccsinstitute.com [online], "2.1 the Properties of CO2," available on or before Oct. 22, 2015, via Internet Archive: Wayback Machine URL <https://hub.globalccsinstitute.com/publications/hazard-analysis-offshore-carbon-capture-platforms-and-offshore-pipelines/21-properties-co2>,12 pages.

Jensen, "Thermally induced hydraulic fracturing of cold water injectors," WPC-26154, World Petroleum Conference (WPC), 14th World Petroleum Congress, May 29-Jun. 1, 1994, 2 pages.

Kern et al., "Propping Fractures with Aluminum Particles," SPE-1573-G-PA, Society of Petroleum Engineers (SPE), Journal of Petroleum Technology, Jun. 1961, 13:6 (583-589), 7 pages.

Masa and Kuba, "Efficient use of compressed air for dry ice blasting," Journal of Cleaner Production, 111:A, Jan. 2016, 9 pages.

Mayerhofer et al., "Proppants? We Don't Need No Proppants," SPE-38611, Society of Petroleum Engineers (SPE), presented at the SPE Annual Technical Conference and Exhibition, 457-464, Oct. 5, 1997, 8 pages.

Meyer et al., "Theoretical Foundation and Design Formulae for Channel and Pillar Type Propped Fractures—A Method to Increase Fracture Conductivity," SPE-170781-MS, Society of Petroleum Engineers (SPE), presented at SPE Annual Technical Conference and Exhibition, Amsterdam, The Netherlands, Oct. 27-29, 2014, 25 pages.

Mueller et al., "Stimulation of Tight Gas Reservoir using coupled Hydraulic and CO2 Cold-frac Technology," SPE 160365, Society of Petroleum Engineers (SPE), presented at the SPE Asia Pacific Oil and Gas Conference and Exhibition, Oct. 22-24, 2012, 7 pages.

(56) References Cited

OTHER PUBLICATIONS

Palisch et al., "Determining Realistic Fracture Conductivity and Understanding its Impact on Well Performance—Theory and Field Examples," SPE-106301-MS, Society of Petroleum Engineers (SPE), presented at the 2007 Hydraulic Fracturing Technology Conference, College Station, Texas, Jan. 29-31, 2007, 13 pages.
Praxair, "Carbon Dioxide, Solid or Dry Ice, Safety Data Sheet P-4575," Praxair, Jan. 1, 1997, 7 pages.
princeton.edu [online], "Bernoulli's Equation," available on or before Jul. 24, 1997, via Internet Archive: Wayback Machine URL <https://www.princeton.edu/~asmits/Bicycle_web/Bernoulli.html>, 5 pages.
Singh et al., "Introduction to an Effective Workover Method to Repair Causing Leak," SPE-194654-MS, Society of Petroleum Engineers (SPE), presented at the SPE Oil and Gas India Conference and Exhibition, Apr. 9-11, 2019, 7 pages.
Soreide et al., "Estimation of reservoir stress effects due to injection of cold fluids: an example from NCS," ARMA 14-7394, American Rock Mechanics Association, presented at the 48th US Rock mechanics/Geomechanics Symposium, Jun. 1-4, 2014, 7 pages.
Takahashi et al., "Degradation Study on Materials for Dissolvable Frac Plugs," URTEC-2901283-MS, Unconventional Resources Technology Conference (URTC), presented at the SPE/AAPG/SEG Unconventional Resources Technology Conference, Jul. 23-25, 2018, 9 pages.
Tinsley and Williams, "A new method for providing increased fracture conductivity and improving stimulation results," SPE-4676-PA, Society of Petroleum Engineers (SPE), Journal of Petroleum Technology, 27:11 (1317-1325), 1975, 7 pages.
Van Poollen et al., "Hydraulic Fracturing—Fracture Flow Capacity vs Well Productivity," SPE-890-G, Society of Petroleum Engineers (SPE), Petroleum Transactions AIME, 213: 91-95, 1958, 5 pages.
Van Poollen, "Productivity vs Permeability Damage in Hydraulically Produced Fractures," SPE-906-2-G, Society of Petroleum Engineers (SPE), presented at Drilling and Production Practice, New York, New York, Jan. 1957, 8 pages.
Vincent, "Examining our Assumptions—Have oversimplifications jeopardized our ability to design optimal fracture treatments," SPE-119143-MS, Society of Petroleum Engineers (SPE), presented at the SPE Hydraulic Fracturing Technology Conference, The Woodlands, Jan. 19-21, 2009, 51 pages.
Vincent, "Five Things you Didn't Want to Know about Hydraulic Fractures," ISRM-ICHF-2013-045, presented at the International Conference for Effective and Sustainable Hydraulic Fracturing, an ASRM specialized Conference, Australia, May 20-22, 2013, 14 pages.
Weinstein, "Cold Waterflooding a Warm Reservoir," SPE 5083, Society of Petroleum Engineers (SPE), presented at the 49th Annual Fall Meeting of the Society of Petroleum Engineers of AIME, Oct. 6-9, 1974, 16 pages.
Williams et al., "Acidizing Fundamentals," Society of Petroleum Engineers of AIME, Jan. 1979, 131 pages.
Yu et al., "Chemical and Thermal Effects on Wellbore Stability of Shale Formations," SPE 71366, Society of Petroleum Engineers (SPE), presented at the 2001 SPE Annual Technical Conference and Exhibition, Sep. 30-Oct. 3, 2001, 11 pages.

* cited by examiner

SEALING CRACKED CEMENT IN A WELLBORE CASING

TECHNICAL FIELD

This disclosure relates to wellbores, particularly, to casing installed in wellbores.

BACKGROUND OF THE DISCLOSURE

Wellbores in an oil and gas well are filled with both liquid and gaseous phases of various fluids and chemicals including water, oils, and hydrocarbon gases. The fluids and gasses in the wellbore can be pressurized. A cased wellbore is a wellbore that has been sealed from the Earth and various sub-surface formations of the Earth. The cased wellbore can be sealed from the formations of the Earth by one or more casing tubulars. The annulus between the casing tubulars and the formations of the Earth can be filled with cement to seal the casing tubular to the formation of the Earth and prevent pressurized water, oil, and hydrocarbon gasses from flowing through the annulus to a surface of the Earth. The cement sealing the annulus can become cracked due to temperature or pressure cycles, inadequate cementing procedures, or downhole tools impact the casing causing vibration. The casing tubular can corrode or become damaged, creating a fluid pathway from the fluid filled wellbore through the casing tubular into the cracked cement in the annulus through which the pressurized liquids and gases can leak. The pressurized water, oil, and hydrocarbon gasses can subsequently leak to the surface of the Earth. Alternatively or in addition, the cracked cement can deteriorate the structural integrity of the wellbore.

SUMMARY

This disclosure describes technologies related to methods for sealing cracked cement in a wellbore casing. Implementations of the present disclosure include a method for sealing a cracked casing cement. In a wellbore in which a casing is deployed, the casing and the wellbore define an annulus sealed with a casing cement. The method vibrating a portion of the casing cement adjacent an outer wall of the casing. The portion of the casing cement includes multiple discrete cracks. Vibrating the casing cement connects the discrete cracks to form a crack network.

In some implementations, the portion of the casing cement adjacent the outer wall of the casing includes the casing cement in direct contact with the outer wall of the casing.

In some implementations, vibrating the portion of the casing cement includes applying a vibration to an inner wall of the casing adjacent the portion of the casing cement. The casing transmits the vibration to the portion of the casing cement. Applying the vibration can include determining a contact frequency and a contact force to repetitively vibrate the casing at the contact frequency and the contact force. The contact frequency and the contact force enlarge and connect the discrete cracks to create the crack network.

In some implementations, vibrating the portion of the casing cement includes impacting the casing with an impactor to vibrate the portion of the casing cement in the annulus. Vibrating the portion of the casing cement in the annulus can create vibration in a vicinity of the casing where a vibration tool contacts the casing. Impacting the casing with the impactor can include mechanically impacting the casing with the impactor. Impacting the casing with the impactor can include fluidically impacting the casing with the impactor.

In some implementations, the method can further include perforating the casing to remove a portion of the casing to fluidically couple the casing to the crack network. The casing is perforated with a casing tool to remove the portion of the casing.

The method includes, after vibrating the casing cement to form the crack network, injecting a sealant into the crack network through the casing. The sealant seals the crack network. Injecting the sealant can include fluidically coupling a sealing tool to the crack network through the casing. The sealing tool injects the sealant into the crack network. Injecting the sealant can include flowing the sealant through the sealing tool. Injecting the sealant can include injecting the sealant into the crack network to create a sealed crack network. Injecting the sealant can include fluidically decoupling the sealing tool from the sealed crack network.

In some implementations, the method can further include, after injecting the sealant into the crack network, patching the casing to further seal the crack network. Patching the casing can include attaching a patch to an inner wall of the casing adjacent to the crack network to seal the crack network.

Further implementations of the present disclosure include a wellbore tool. The wellbore tool includes a vibration sub-assembly includes a first vibration head to repetitively contact a casing of a wellbore. The casing and the wellbore define an annulus sealed with a casing cement. A portion of the casing cement adjacent an outer wall of the casing include multiple discrete cracks. The vibration sub-assembly can include a second vibration head.

The wellbore tool includes a vibration drive operatively coupled to the vibration sub-assembly to operate the first vibration head to create vibration in a portion of the casing and a vicinity of the casing where the first vibration head contacts the casing. The vibration drive can include a power source to supply power to the vibration sub-assembly. The vibration drive can to operate the first vibration head to repetitively contact the casing at a contact frequency and a contact force. The vibration drive can include a wedge operatively coupled to the first vibration head and the second vibration head. The wedge moves the first vibration head and the second vibration head to contact the casing. The vibration drive can include multiple springs operatively coupled to the first vibration head and the second vibration head. The springs move the first vibration head and the second vibration head out of contact with the casing.

The wellbore tool includes a tool body to accept the vibration sub-assembly and the vibration drive. The tool body is disposed in the wellbore. The tool body includes a first opening to pass the first vibration head through the first opening to repetitively contact the casing. The tool body can include a third opening to pass the second vibration head through a third opening to repetitively contact the casing.

In some implementations, an anchor is mechanically coupled to the tool body to optionally engage the tool body to the casing. When the anchor is disposed within the tool body, the tool body includes a second opening to pass the anchor through the second opening to engage the tool body to the casing.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION OF THE DISCLOSURE

The present disclosure relates to sealing casing cement that seals an annulus defined by an inner wall of a wellbore and a casing tubular disposed within the wellbore. The casing cement includes multiple cracks. Sealing the casing cement includes filling the multiple cracks. To seal the cracks, the casing cement is first vibrated to enlarge and subsequently connect the cracks to create a crack network. Then, a sealant is injected into the crack network through the casing tubular to fill the multiple cracks. In this manner, the sealant seals the crack network.

Implementations of the present disclosure realize one or more of the following advantages. Sealing cracks in casing cement can be simplified and quality of sealing can be improved. In some instances, if cracks in casing cement need to be sealed, the casing in the region of the cracked cement must be completely removed, the cracked cement removed, the section re-cemented, and a liner placed across the section to seal the cracks. By implementing techniques herein, such complex removal and replacement operations can be avoided. Additionally, structural integrity of the wellbore can be preserved. Also, environmental safety can be improved. Cracks in casing cement can allow pressurized fluids and gasses from formations of the Earth to leak to the surface through the cracks. By implementing techniques herein, the cracked casing cement can be sealed to prevent contaminating the surface of the Earth surrounding the wellbore. Environmental remediation cost and time can be reduced by minimizing the amount of hydrocarbons that may be leaked through the cracked casing cement to the surface. Additionally, personnel safety can be improved. Personnel exposure to leaked hazardous pressurized fluids and gasses can be decreased. Leaking pressurized fluids and gasses through cracked casing cement to improve environmental safety and personnel safety can be achieved. Other advantages include increasing wellbore production longevity. A cracked wellbore cement can be sealed, extend operation well lifetime so a leaking wellbore does not need to be plugged and abandoned before the end of its production life. Well stability can be maintained or improved by sealing the cracks in the cement.

Figure 1A:
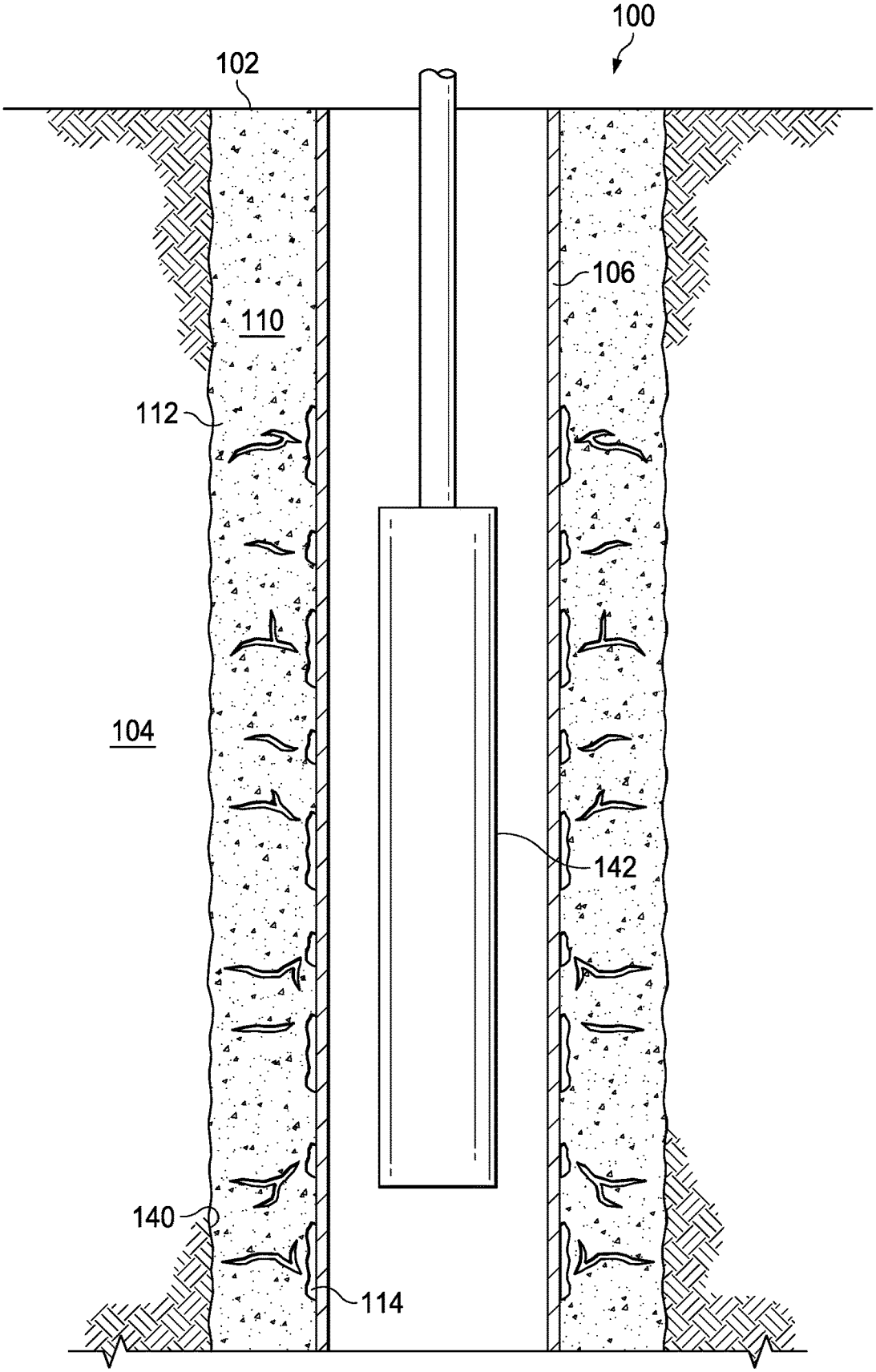
FIG. 1A is a schematic view of a wellbore with cracked casing cement.

FIGS. 1A-1F show the process for sealing a wellbore 100. FIG. 1A is a schematic view of a wellbore with cracked casing cement. Referring to FIG. 1A, the wellbore 100 extends from a surface 102 of the Earth through the formations 104 of the Earth. The wellbore 100 conducts fluids and gases from the formations 104 of the Earth to the surface 102 of the Earth. Additionally, completion tools (not shown) or remediation tools, described later, can be disposed into the wellbore 100 to remove the fluids and gasses from the formations 104 and transport the fluids and gasses to the surface 102. In some cases, disposing the completion tools or remediation tools can accidentally damage the wellbore 100.

A casing 106, for example, a hollow tubular member, can be positioned in the wellbore 100 to conduct the fluids and the gasses through the casing 106. The casing 106 can be a metal tubular, such a steel. Multiple steel tubulars can be coupled together to form the casing 106. The outer surface of the casing 106 and an inner surface 140 of the wellbore 100 define an annulus 110. The annulus 110 can be filled with cement 112. When filled, the cement 112 is free of cracks. Over time, cracks 114 form in the cement 112. The cracked cement 112 no longer seals the annulus 110 of the wellbore 100 from the surface 102 of the Earth.

The cracks 114 can occur in cement 112 for one or multiple reasons. For example, cracks 114 can occur due to an inadequate cement completion process. An incorrect cement physical and chemical composition for a given wellbore condition can result in casing cement cracking. Additionally, improper cement pumping parameters during a wellbore completion process can result in casing cement cracking. Also, casing cement can crack due to long term casing corrosion. Casing cement can crack due to changes in temperature or pressure. Casing cement can crack due to formation 104 failure. Additionally, casing cement can be damage through intervention activities, such as fracturing the formations 104 of the Earth. The casing cement damage occurs at the metallic casing and cement interface such that relative 'movement' of the metallic casing due to temperature change, pressure change, formation stress change on the casing, and/or the difference in mechanical properties between the casing and cement (for example, the coefficient of expansion, the toughness, or the ductility). This type of failure occurs during the life of a well whereas issues such as poor cement job are identified immediately or early on the well completion.

In some cases, a portion of the cracks 114 in the cement 112 can be concentrated in the immediate region around the entire circumference of the casing 106 allowing hydrocarbons or water to flow to the surface 102 of the Earth. Such concentration of the cracks 114 can be due to an expansion/contraction of the casing 106.

The cracks 114 can be micro-channels. Micro-channels can allow for the migration of hydrocarbons and water to migrate to the surface 102 of the Earth through the cement 112. Over time, micro-channels can form and expand due to pressure or temperature cycles (for example, the effect of such cycles on the material of the casing 106) or damage from completion operations, resulting in increased hydrocarbon leakage. The micro-channels can connect to one another, and then up to the surface 102. A crack can be an isolated micro-channel that is not connected to another crack. Alternatively or in addition, some of the cracks can be interconnected to form a channel which does not extend to the surface 102. The cracks 114 can be detrimental to wellbore stability and need to be filled to safely continue wellbore 100 operation. However, because the micro-channels are small, not entirely interconnected gaps, some of which are concentrated in the region between the casing 106 or a liner (not shown) and the surrounding cement 112 in the annulus 110, filling in all or substantially all (for example, at least 85% or more) of the cracks 114, particularly, in the region between the casing 106 and the surrounding cement 112 can be difficult. The importance of a crack 114 size is the ability of pump a cure into the cracks 114. The smaller the crack 114 the harder it becomes and less likely to achieve full penetration into the crack 114. Making the cracks 114 bigger allows for full penetration of the cure. The cure can be an ultra-fine cement or a polymeric resin of low viscosity.

A tool 142 can be positioned within the casing 106 in the region of the cracks 114 to seal the cracks 114. The region of the cracks 114 can be located by performing a logging operation to identify the leak zone. For example, an ultrasonic or acoustic logging operation can be performed. Additionally, confirmation of a leak zone is also done by punching holes in a casing at intervals and testing to see if pressure communication between the holes exists. The various implementations of the tool 142 are described later.

Figure 1B:
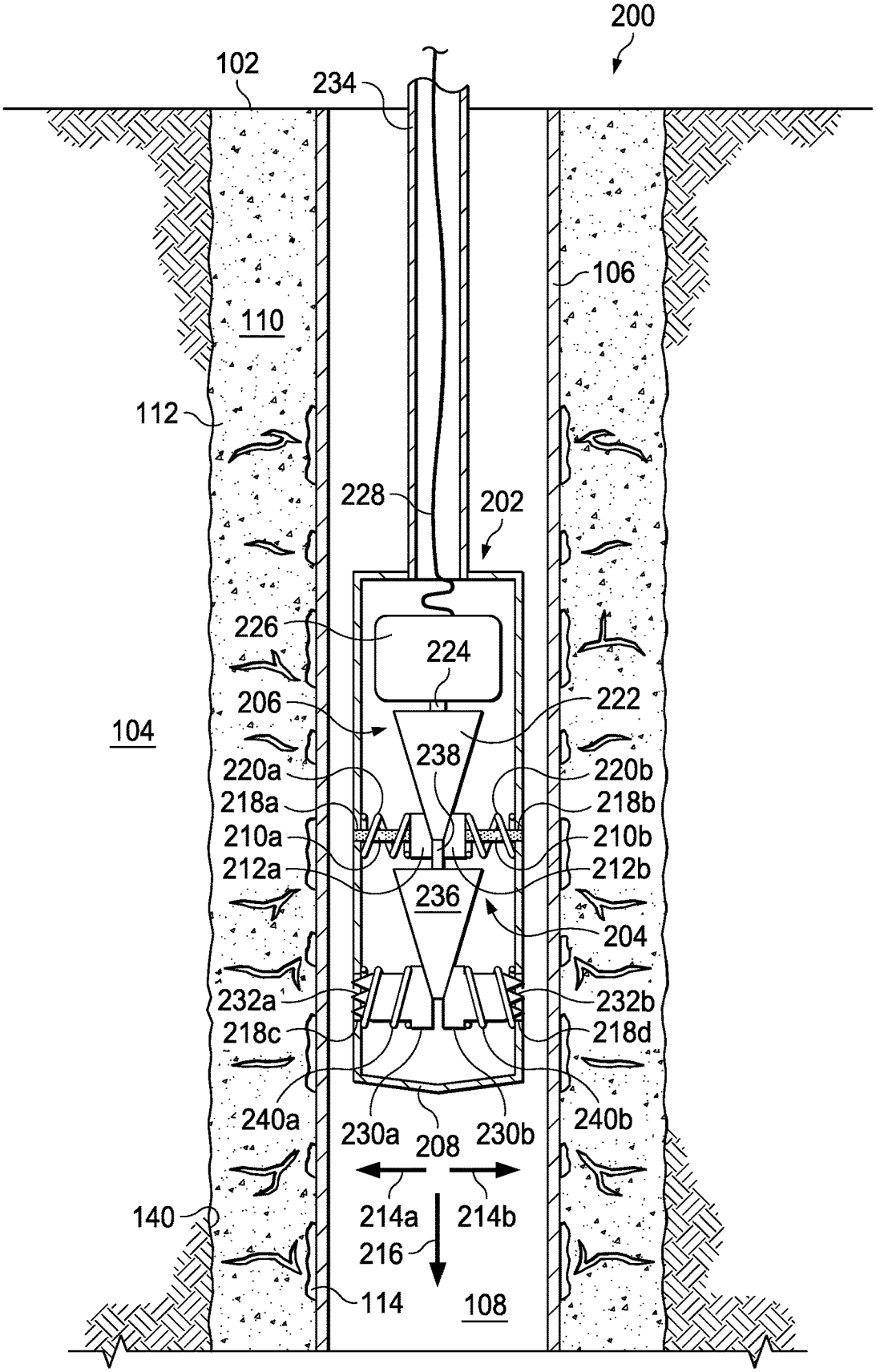
FIG. 1B is a schematic view of an implementation of a tool for vibrating the casing and the cracked casing cement.

FIG. 1B is a schematic view of an implementation of a tool for vibrating the casing and the cracked casing cement. As shown in FIG. 1B, the process to seal a cracked casing cement includes vibrating the casing 106. Referring to FIG. 1B, a vibration tool 202 is disposed within the casing 106. The vibration tool 202 is a first implementation of the tool 142. The vibration tool 202, as shown in FIG. 1B, is disengaged from the casing 106. The vibration tool 202 includes a vibration sub-assembly 204 and a vibration drive 206 positioned within and coupled to a tool body 208.

The vibration sub-assembly 204 includes a first vibration head 210*a* to repetitively contact the casing 106 to vibrate the casing 106. The first vibration head 210*a* vibrates the portion of the casing 106, which transmits the vibration to the cement 112 in the vicinity of the casing 106 where the first vibration head 210*a* contacts the casing 106. The first vibration head 210*a* can have a flat, rounded, single point, or multi-pointed head to impact the casing.

The first vibration head 210*a* is mechanically coupled to a first vibration drive receiver 212*a*. The vibration drive 206 moves a driving wedge 222 (described later) axially in the direction of arrow 216 to displace the first vibration drive receiver 212*a*. Displacing the first vibration drive receiver 212*a* moves the first vibration head 210*a* radially in the direction of arrow 214*a*.

The first vibration head 210*a* is positioned within the tool body 208. The tool body 208 surrounds and holds the vibration sub-assembly 204 and the vibration drive 206. The tool body 208 is configured to be disposed within the casing 106. For example, the tool body 208 protects the vibration sub-assembly 204 and the vibration drive 206 from wellbore conditions such as, for example, heat, liquid, or corrosive chemicals The tool body 208 has a first opening 218*a* to allow a portion of the first vibration head 210*a* to pass through the tool body 208 to repetitively contact the casing 106.

The vibration drive 206 is operatively coupled to the vibration sub-assembly 204 to operate the first vibration head 210*a* to create vibration in the portion of the casing 106 and the vicinity of the casing 106 where the first vibration head 210*a* contacts the casing 106. The vibration drive 206 is contained within the tool body 208 and mechanically coupled to the tool body 208. The vibration drive 206 moves towards (downwards) the vibration heads 210*a* and 210*b* such that the vibration heads 210*a* and 210*b* are deployed to contact the casing 106. The vibration drive 206 can include an internal slide mechanism (not shown) to guide the movement and direction a driving wedge 222.

The vibration drive 206 includes the driving wedge 222. The driving wedge 222 is shaped to contact the first vibration drive receiver 212*a* and repetitively move the first vibration drive receiver 212*a* radially in the direction of an arrow 214*a*. The driving wedge 222 can be shaped, for example, as an isosceles triangle, an equilateral triangle, a cone, or a frustoconical shape. The drive wedge 222 is a coned cam such that as it is rotated by a power source 226 it imparts a linear motion to the vibration heads 210*a* and 210*b*. The driving wedge 222 is connected to the power source 226 by a vibration drive linkage 224. The vibration drive linkage 224 mechanically couples the driving wedge 222 to the power source 226.

The power source 226 is a rotational motor. The rotational motor can be either electrically or hydraulically powered. Alternatively, the power source 226 can be a linear drive that imparts a vibration directly to the driving wedge 222. When the power source 226 is a liner motor, the driving wedge 222 is a true wedge (as opposed to a cam). The linear drive power source can be electrically or hydraulically powered.

The vibration sub-assembly 204 can include a first spring 220*a* to return the vibration heads to a reset position for the vibration drive 206 to repetitively cycle the first vibration head 210*a* to impact the casing 106. The first spring 220 can be one or multiple springs. The first spring 220*a* is coupled to the first vibration head 210*a*. When the driving wedge 222 is driven axially in the direction of arrow 216, the first vibration head 210*a* is driven radially, and the first spring 220*a* compresses. When the driving wedge 222 is drawn back axially in the opposite direction of arrow 216, the first spring 220*a* expands and return the first vibration head 210*a* radially in the direction of arrow 214*b* and out of contact with the casing 106. The first spring 220*a* forces the first vibration head 210*a* to retract into the tool body 208 when the driving wedge 222 is retracted (the vibration stops). The first spring 220*a* holds the first vibration head 210*a* against the moving driving wedge 222 and continually retract vibration head 210*a*. The first spring 220*a* maintains the first vibration head 210*a* in contact with the driving wedge 222.

The vibration tool 202 can contain multiple vibration heads. For example, the vibration tool 202 can include two, three, four, or five vibration heads. As shown in FIG. 1B, the vibration tool 202 includes a second vibration head 210*b*, substantially similar to the first vibration head 210*a* described previously to repetitively contact the casing 106 to vibrate the casing 106. The second vibration head 210*b* is mechanically coupled to a second vibration drive receiver 212*b* substantially similar to the first vibration drive receiver 212*a* previously described. The vibration drive 206 moves the driving wedge 222 axially in the direction of arrow 216 to displace the second vibration drive receiver 212*b*. Displacing the second vibration drive receiver 212*b* moves the second vibration head 210*b* radially in the direction of an arrow 214*b*.

The second vibration head 210*b* is positioned within the tool body 208. The tool body 208 has a second opening 218*b* to allow a portion of the second vibration head 210*b* to pass through the tool body 208 to repetitively contact the casing 106.

The vibration drive 206 is operatively coupled to the vibration sub-assembly 204 to operate the second vibration head 210*b* to create vibration in the portion of the casing 106 and the vicinity of the casing 106 where the second vibration head 210*b* contacts the casing 106. The driving wedge 222 is shaped to contact a second vibration drive receiver 212*b* and repetitively move the second vibration drive receiver 212*b* radially in the direction of arrow 214*b*.

The vibration sub-assembly 204 can include additional springs to return the vibration heads to a reset position for the vibration drive to repetitively cycle the second vibration head 210*b* to impact the casing 106. A second spring 220*b* can be coupled to the second vibration head 210*b*. When the driving wedge 222 is driven axially in the direction of arrow 216, the second vibration head 210*b* is driven radially, and the second spring 220*ba* compresses. When the driving wedge 222 is drawn back axially in the opposite direction of arrow 216, the second spring 220*b* expands and return the second vibration head 210*b* radially in the direction of arrow 214*b* and out of contact with the casing 106.

The power source 226 supplies power to the vibration sub-assembly 204. The power source 226 provides the motive force to operate the driving wedge 222. The power source 226 can be a hydro-mechanical source. For example, a hydro-mechanical power source can use a fluid flow from the 102 surface or an internal fluid source (not shown) can be used to power hydraulic valves (not shown) or hydraulic motors (not shown) to move the driving wedge 222. Alternatively, the power source 226 can be an electro-mechanical power source. For example, an electro-mechanical power source can use electrical energy from stored energy in a battery pack, generated electrical energy from downhole turbines, or conveyed electrical energy from a power cable 228 to power the driving wedge 222. The electro-mechanical power source can include electric motors with an offset mass, electromagnetic linear actuators, piezo-electric actuators, or memory wire actuators to actuate the driving wedge 222. The power cable 228 can include a control cable. The control cable carries control signals between an operator and the vibration tool 202.

The power cable 228 and the control cable can be contained within a downhole conveyer 234. The vibration tool 202 is coupled to the downhole conveyer 234. The downhole conveyer 234 conducts the vibration tool 202 into the casing 106 to the region of the cement 112 with cracks 114. The downhole conveyer 234 can be, for example, production tubing, wireline, or coiled tubing.

The vibration drive 206 drives the first vibration head 210*a* and the second vibration head 210*b* to repetitively contact the casing 106 at a contact frequency and a contact force. The contact frequency and the contact force are sufficient induce a mechanical vibration in the casing that is of a magnitude and an amplitude to increase the cracks 114 size and length in the cement in the region in the immediate vicinity of the outer wall of the casing and to interconnect the cracks. The first vibration head 210*a* and the second vibration head 210*b* to repetitively contact the casing 106 with the contact force at the contact frequency to break down of the cracks 114 without causing damage to the casing 106 and other completion components (not shown) contained within the wellbore 100.

The contact frequency can be a low to medium frequency vibration. The low to medium frequency vibrations are shallow, in that they vibrate the casing 106 and cement 112 only in the region near where the vibration heads 210*a* and 210*b* contact the casing 106. The low to medium frequency vibrations do not have deep penetration of destructive vibration into the cement, in that they do not carry a long way, causing damage to other wellbore 100 completion components. The low to medium frequency vibrations excite the casing 106 locally to cause the cracks 114 at the interface of the casing 106 and the cement 112 to break down.

The vibration tool 202 can include a first anchor 230*a* to selectively engage the vibration tool 202 to the casing 106. The first anchor 230*a* is mechanically coupled to the tool body 208. The anchor can include teeth 232 to engage the casing 106. The first anchor 230*a* can be positioned in the interior of the tool body 208. The tool body 208 has a third opening 218*c* and to pass the first anchor 230*a* through the tool body 208 to engage the casing 106.

The same downward movement of the vibration drive 206 to actuate the driving wedge 222 moves an anchor wedge 236 coupled to the anchor wedge by an anchor linkage 238. The anchor wedge 236 moves the first anchor 230*a* to engage with the casing 106. The first anchor 230*a* includes a first anchor spring 240*a* such that retraction of the anchor wedge 236 would cause the first anchor 230*a* to retract (disengage from the casing 106). Alternatively, a linear motor can push the first anchor 230*a* out of the tool body 208. Alternatively, the first anchor 230*a* can be positioned exterior to the tool body 208 or in a recess (not shown) of the tool body. The vibration tool 202 can include multiple anchors. For example, the vibration tool 202 can include two, three, four, five, or more anchors. As shown in FIG. 1B, the vibration tool 202 includes a second anchor 230*b* substantially similar to the first anchor 230*a* disposed within the tool body 208, with a second anchor spring 240*b*. The tool body 208 has a fourth opening 218*d* and to pass the second anchor 230*b* through the tool body 208 to engage the casing 106.

Alternatively, the anchors 230*a* and 230*b* can be a slip (not shown). The slip is a circular wedge mechanically coupled to and contained with the tool body 208. The slip is deployed from within the tool body 208 to contact the casing 106. The slip is deployed by moving an opposing wedge (not shown), also inside the tool body 208.

Figure 1C:
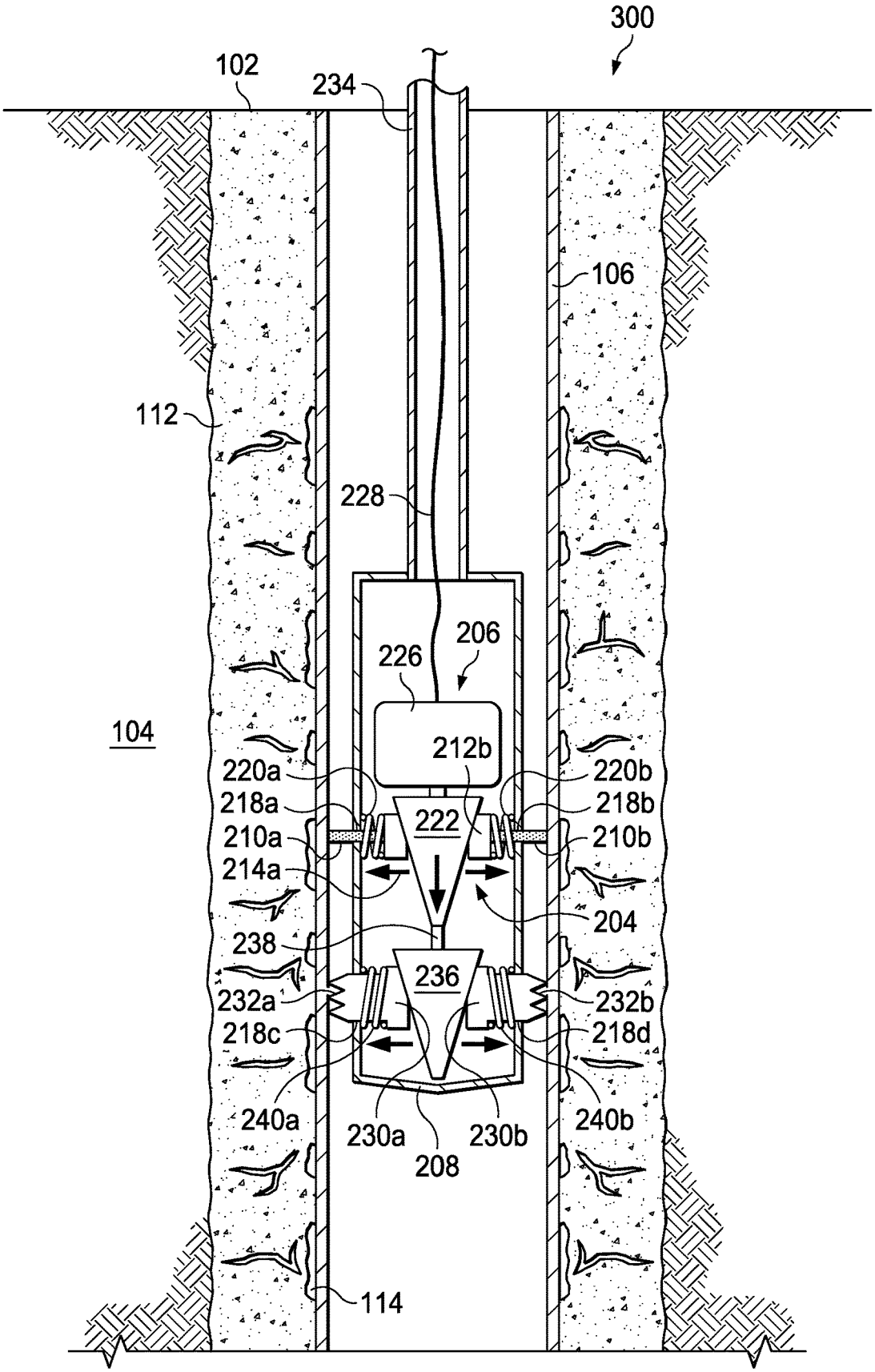
FIG. 1C is a schematic view of the tool of FIG. 1B anchored to the casing.

FIG. 1C is a schematic view of the tool of FIG. 1B anchored to the casing. Referring to FIG. 1C, the anchors 230*a* and 230*b* are moved radially to engage to the casing 106 in the direction of a first arrow 336*a* and a second arrow 336*b*, respectively. The first anchor 230*a* has passed through the third opening 218*c* in the tool body 208 and the second anchor 230*b* has passed through the fourth opening 218*d* to engage the casing 106. Engaging the anchors 230*a* and 230*b* to the casing 106 holds the tool body 208 in the vicinity of the cracks 114 so the first and vibration heads 210*a* and 210*b* can contact the casing 106. The teeth 232 of the first anchor 230*a* and the second anchor 230*b* are engaged in the casing 106.

As shown in FIG. 1C, the driving wedge 222 is moved in an axial direction (the downhole direction) in the direction of a third arrow 336*c* by the power source 226. Moving the driving wedge 222 in the axial direction (the third arrow 336*c*) displaces the first vibration drive receiver 212*a* and the second vibration drive receiver 212*b*, compressing the first spring 220*a* and the second spring 220*b*, respectively. The first vibration head 210*a* and the second vibration head 210*b* are forced by the first vibration drive receiver 212*a* and the second vibration drive receiver 212*b*, respectively, through the first opening 218*a* and the second opening 218*b*, respectively, to contact the casing 106. The first vibration head 210*a* and the second vibration head 210*b* contact the casing 106 at the contact frequency and the contact force previously described. The casing 106 transmits the repetitive force to the cracked cement 112. The cracks 114 in the cracked cement 112 are enlarged and connected to other cracks by the repetitive contact force to create a crack network (not shown)

The driving wedge 222 then returns to the position shown in FIG. 1B. This returning movement releases the first vibration drive receiver 212*a* and the second vibration drive receiver 212*b*. The first spring 220*a* and the second spring 220*b* force the first vibration drive receiver 212*a* and the second vibration drive receiver 212*b* toward the driving wedge 222, moving the first vibration head 210*a* and the second vibration head 210*b* inward into the tool body 208 and out of contact with the casing 106. The first anchor 230*a* and the second anchor 230*b* are disengaged from the casing 106. The vibration tool 202 is removed from the casing 106 by the downhole conveyer 234.

Figure 1D:
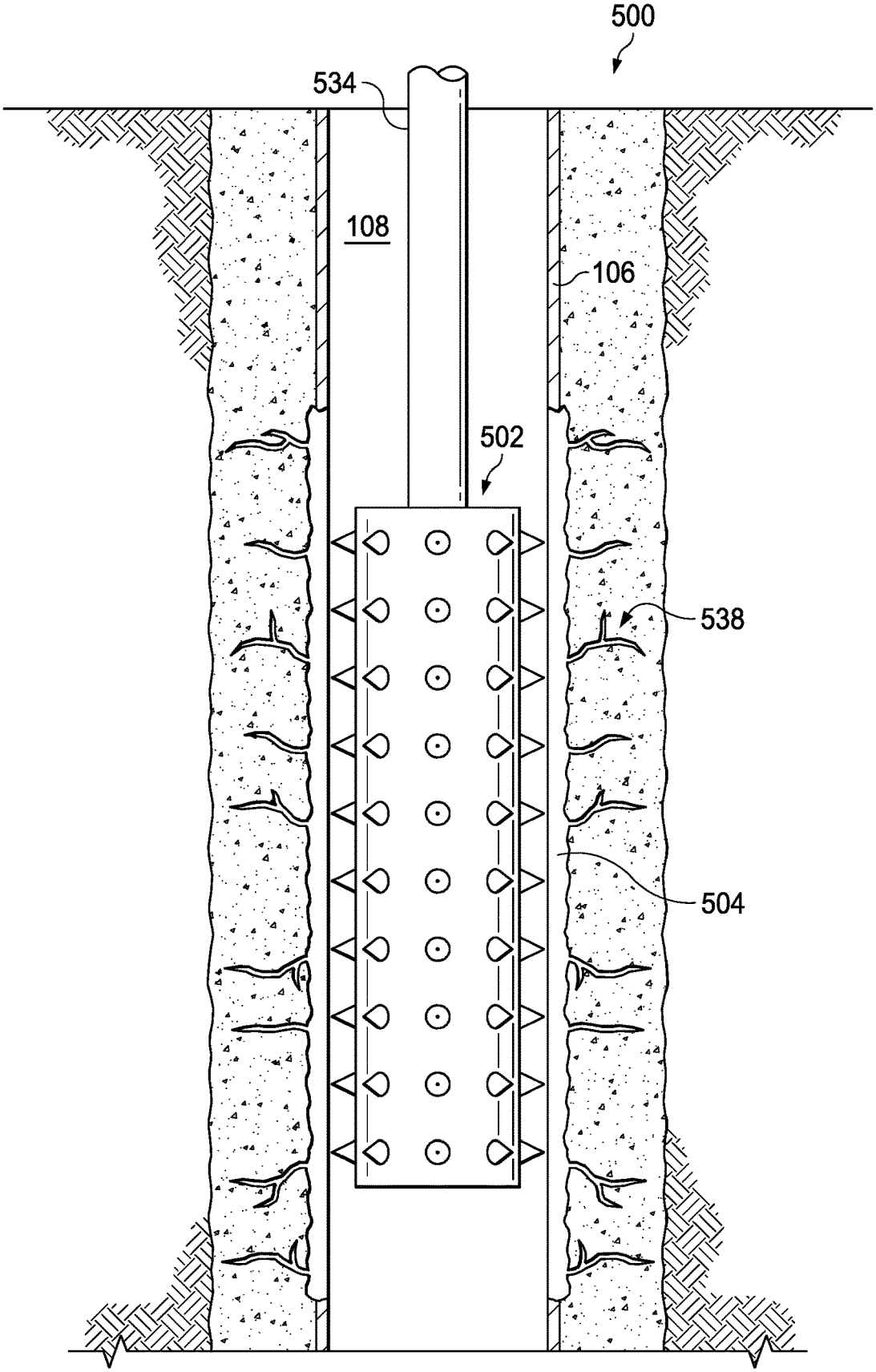
FIG. 1D is a schematic view of a tool for perforating the casing and the cracked casing cement.

FIG. 1D is a schematic view of a tool for perforating the casing and the cracked casing cement. Referring to FIG. 1D, the process to seal a cracked casing cement includes perforating the casing 106. FIG. 1D shows a perforation assembly 500 disposed in the casing 106. The cracks 114 shown in FIGS. 1A-1D have been enlarged and connected to create a crack network 538. The perforation assembly 500 includes a downhole conveyor 534 substantially similar to the downhole conveyors previously described. The perforation assembly 500 includes a perforation tool 502 to perforate or remove a portion of the casing 106 to create perforations 504 to fluidically couple the interior of the casing 106 to the crack network 538. The perforation tool 502 can be a bullet perforator, a jet perforator, or a milling tool (as shown). The casing 106 is perforated to create the perforations 504 for an injection opening.

The perforation assembly 500 is placed in the casing 106. The perforation tool 502 then perforates the casing 106 in the vicinity of the crack network 538. The perforation assembly 500 is then removed from the casing 106.

Figure 1E:
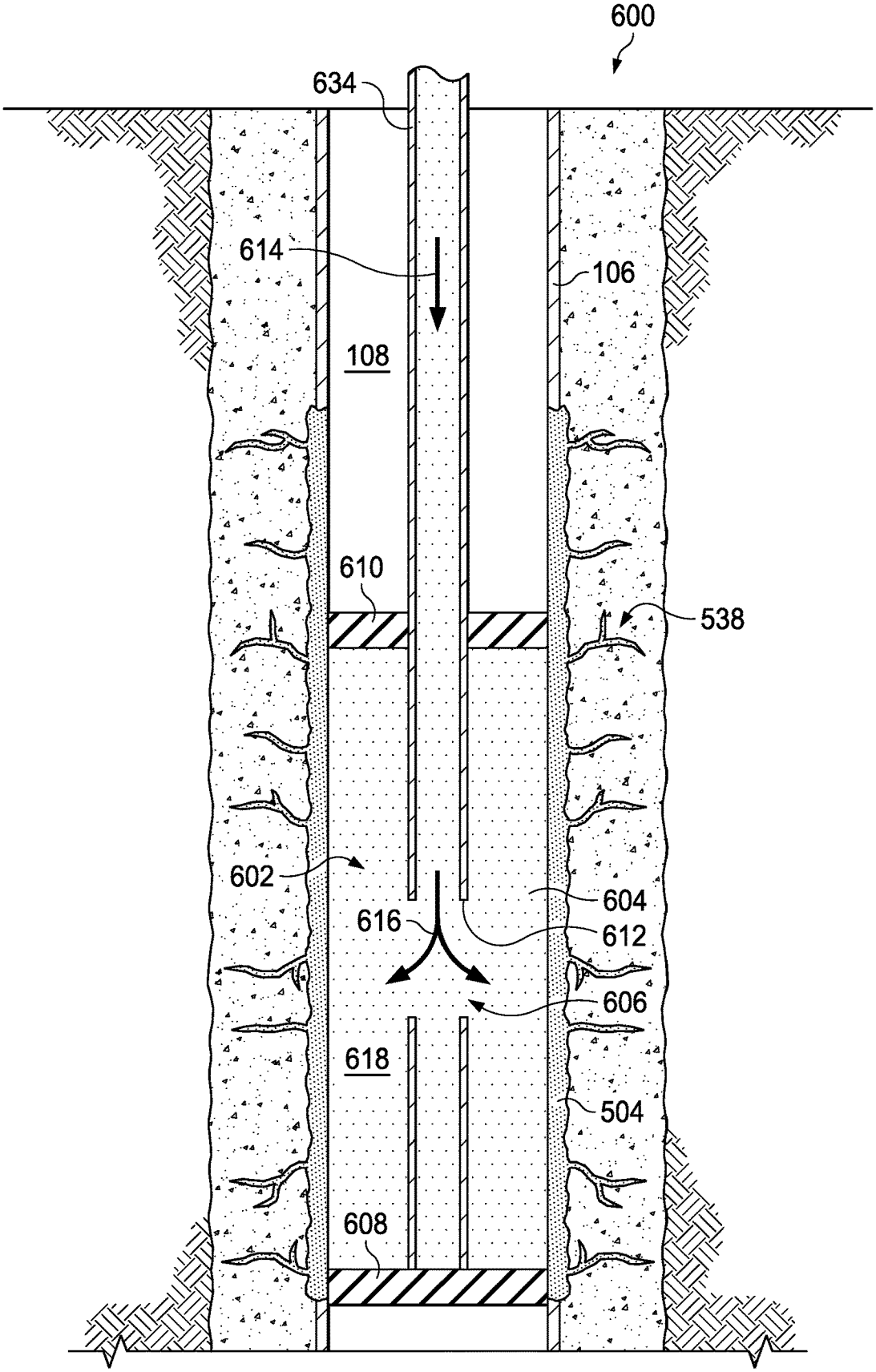
FIG. 1E is a schematic view of tool for sealing the cracked casing cement.

FIG. 1E is a schematic view of tool for sealing the cracked casing cement. As shown in FIG. 1E, the process to seal a cracked casing cement includes flowing a sealant into the crack network. Referring to FIG. 1E, a sealing assembly 600 is disposed in the casing 106 in the vicinity of the crack network 538. The sealing assembly 600 includes a downhole conveyor 634 substantially similar to the downhole conveyors previously described.

The sealing assembly 600 includes a sealing tool 602 to flow a sealant 604 into the crack network 538. The sealing tool 602 includes a ported conduit 612 for the fluid to flow through ports 606 into a void 618 defined by a first sealing element 608, a second sealing element 610, and the casing 106. The first sealing element 608 and the second sealing element 610 engage the interior surface 412 of the casing 106 to prevent fluid flow across the first sealing element 608 and the second sealing element 610. The first sealing element 608 and the second sealing element 610 can be packers or bridge plugs.

The sealant 604 sets (cures) in the crack network 538. The setting of the sealant 604 in the crack network 538 prevents fluid from flowing in the crack network 538. The sealant 604 can be a polymeric or cement.

The sealing assembly 600 is operated as follows to seal the crack network 538. The sealing assembly 600 is disposed in the casing 106 in the vicinity of the crack network 538 by the downhole conveyor 634. The first sealing element 608 and the second sealing element 610 of the sealing tool 602 are engaged to the interior surface 412 of the casing 106. The sealant 604 flows down the downhole conveyor from the surface in the direction of arrow 614. The sealant 604 enters the ported conduit 612, then exits the ported conduit through the ports 606 in the direction of arrow 616 into the void 618. The sealant 604 flows from the void 618 into the crack network 538. The sealant 604 sets (cures) in the crack network 538 to create a sealed crack network (shown in FIG. 1F, described below, as sealed crack network 702). The first sealing element 608 and the second sealing element 610 of the sealing tool 602 are disengaged from the interior surface 412 of the casing 106. The sealing assembly 600 is removed from the casing 106 by the downhole conveyor 634.

Figure 1F:
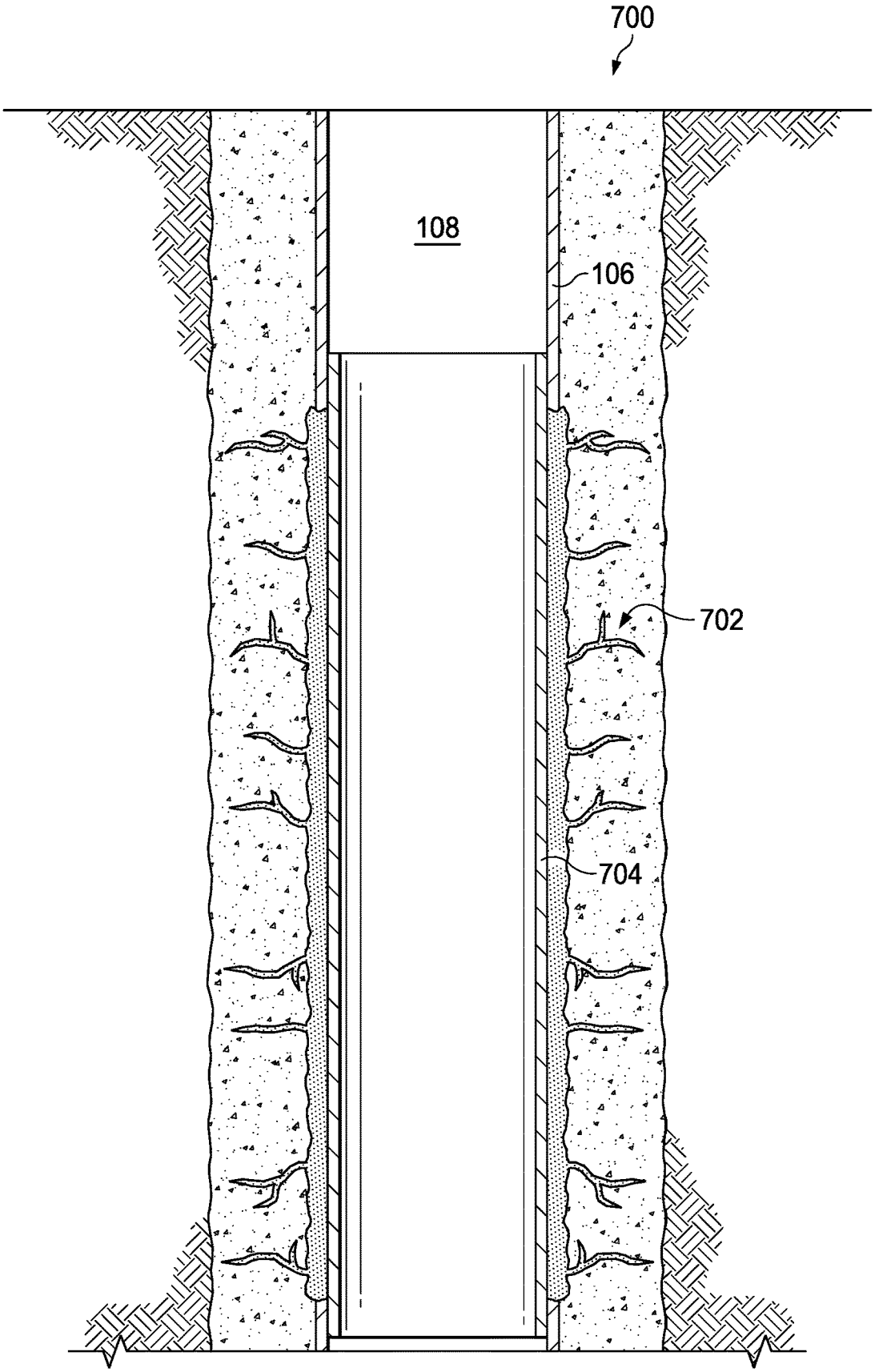
FIG. 1F is a schematic view of a patch for sealing the cracked casing cement of the wellbore.

FIG. 1F is a schematic view of a patch for sealing the cracked casing cement of the wellbore. As shown in FIG. 1F, the process to seal a cracked casing cement can include patching the sealed crack network 702. A patch 704 can be applied to the interior surface 412 of the casing 106 to protect the sealed crack network 702. The patch 704 can be a liner. Alternatively, the patch 704 can be a casing patch.

Figure 2:
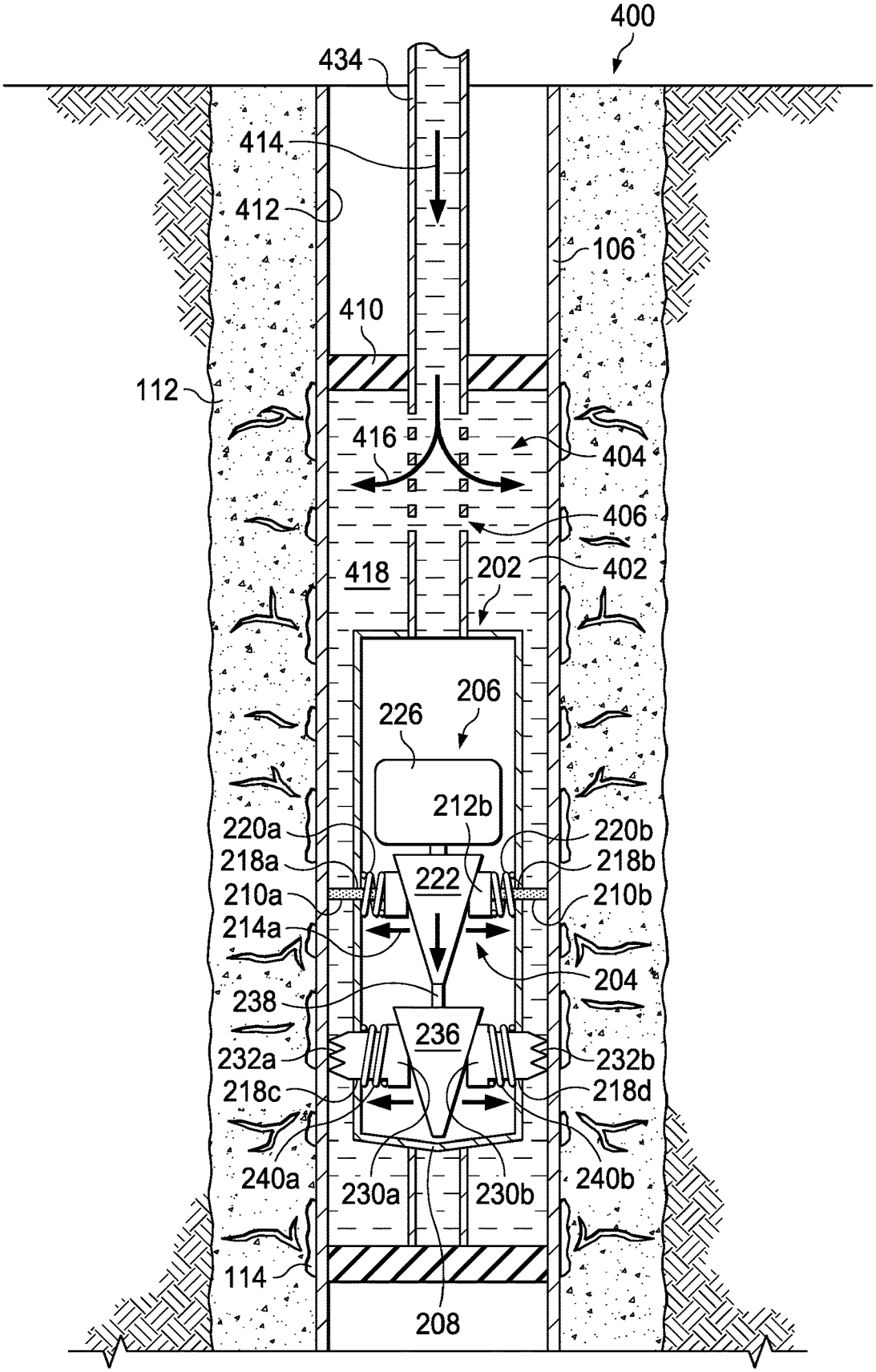
FIG. 2 is a schematic view of another implementation of a tool vibrating the casing and the cracked casing cement.

FIG. 2 is a schematic view of another implementation of a tool vibrating the casing and the cracked casing cement. FIG. 2 shows a second vibration tool 400. The second vibration tool 400 uses a cyclically pressurized fluid 402 in conjunction with the application of mechanical vibration with the vibration tool 202 to vibrate the casing 106 for the casing 106 subsequently vibrate the cement 112 and connect and grow the cracks 114. The second vibration tool 400 has a downhole conveyor 434 to move the second vibration tool 400 to the region of the cracks 114. The downhole conveyor 434 can conduct the cyclically pressurized fluid 402 from the surface (not shown). For example, the downhole conveyor can be a production tubular or a coiled tubing. The fluid 402 is cyclically pressurized by pumping fluid through the coiled tubing in between a first sealing element 408 and a second sealing element 410 creating void 418 where the vibration tool 202 is straddled by the first sealing element 408 and the second sealing element 410. A pump (not shown) pumps a fluid to increase the pressure between the two sealing elements 408 and 410. The pressure is controlled using pumps which can be cycled.

The second vibration tool 400 includes a ported conduit 404 for the fluid to flow through ports 406 into a void 418 defined by a first sealing element 408, a second sealing element 410, and the casing 106. The first sealing element 408 and the second sealing element 410 engage the interior surface 412 of the casing 106 to prevent fluid flow across the first sealing element 408 and the second sealing element 410. The first sealing element 408 and the second sealing element 410 can be packers or bridge plugs.

The second vibration tool 400 is operated as follows to enlarge and connect the cracks 114 in the cement 112 to create a crack network (not shown). The second vibration tool 400 is disposed in the casing 106 in the vicinity of the cracks 114 by the downhole conveyor 434. The first sealing element 408 and the second sealing element 410 are engaged to the interior surface 412 of the casing 106. The cyclically pressurized fluid 402 flows down the downhole conveyor from the surface in the direction of arrow 414. The cyclically pressurized fluid 402 enters the ported conduit 404, then exits the ported conduit through the ports 406 in the direction of arrow 416 into the void 418. The fluid can be cyclically pressurized. The pressure maximum is less than the coiled tubing component and casing 106 maximum pressure ratings. Cyclically pressurizing the fluid 402 vibrates the casing 106. The vibration of the casing 106 vibrates the cracked cement 112, enlarging and connecting the cracks 114 to create a crack network (not shown). The first sealing element 408 and the second sealing element 410 are disengaged from the interior surface 412 of the casing 106. The second vibration tool 400 is removed from the casing 106 by the downhole conveyor 434.

Figure 3:
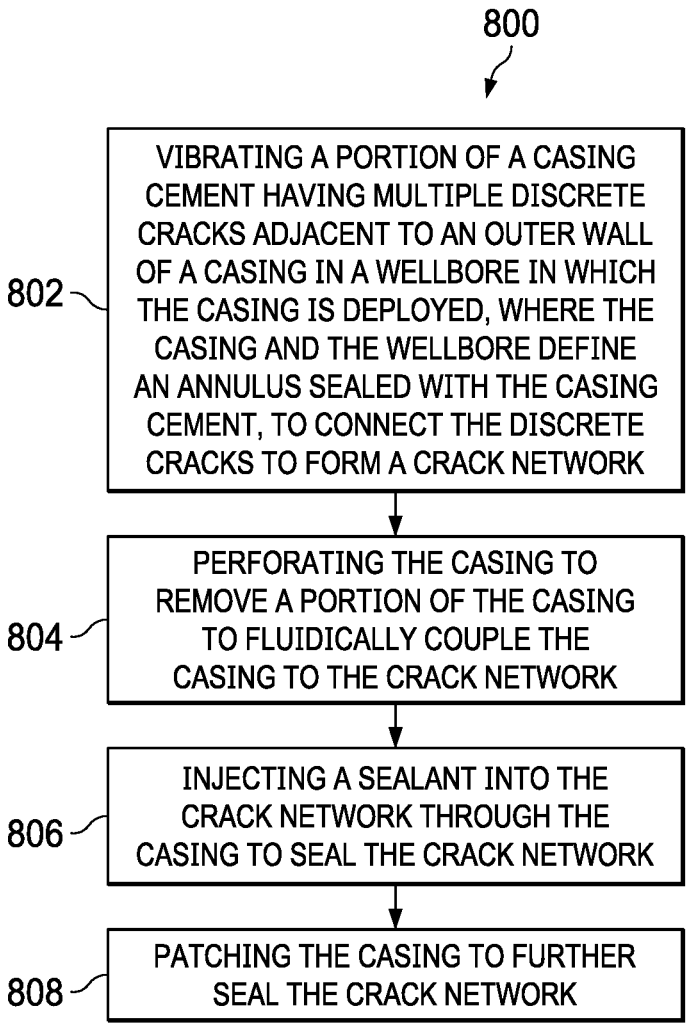
FIG. 3 is a flow chart of an example method of sealing cracked casing cement.

FIG. 3 is a flow chart of an example method of sealing cracked casing cement. FIG. 3 is a flow chart of an example method 800 of sealing cracked casing cement. At 802, in a wellbore in which a casing is deployed, the casing and the wellbore define an annulus sealed with a casing cement. A portion of the casing cement adjacent an outer wall of the casing is vibrated. The portion of the casing cement includes multiple discrete cracks. Vibrating the casing cement connects the discrete cracks to form a crack network. The casing cement can be in direct contact with the outer wall of the casing.

Vibrating the portion of the casing cement can include applying a vibration to an inner wall of the casing adjacent the portion of the casing cement. The casing transmits the vibration to the portion of the casing cement. A contact frequency and a contact force can be determined to repetitively vibrate the casing at the contact frequency and the contact force. The contact frequency and the contact force enlarge and connect the discrete cracks to create the crack network.

An impactor can impact the casing to vibrate the portion of the casing cement in the annulus. Vibrating the portion of the casing cement in the annulus can create a vibration in a vicinity of the casing where a vibration tool contacts the casing. The impactor can mechanically impact the casing. The impactor can fluidically impact the casing.

At 804, prior to injecting the sealant into the crack network, the casing is perforated to remove a portion of the casing with a perforation tool to fluidically couple the hollow casing to the crack network.

At 806, after vibrating the casing cement to form the crack network, a sealant is injected into the crack network through the casing. The sealant seals the crack network. A sealing tool can be fluidically coupled to the crack network through the casing. The sealing tool injects the sealant into the crack network. The sealant flows through the sealing tool. The sealant injected into the crack network creates a sealed crack network. The sealing tool is then fluidically decoupling from the sealed crack network.

At 808, after injecting the sealant into the crack network, the casing can be patched to further seal the crack network. A patch can be attached to an inner wall of the casing adjacent to the crack network to seal the crack network.

Sealing a single annulus in a single casing has been shown. This can be done with multiple casings, disposed one within the other. The multiple casings define multiple annuli which are then each filled with cement. Multiple casings are used to complete the wellbore 100 to seal off selected regions as the wellbore 100 depth from the surface 102 of the Earth progressively increases.

Figure 4B:
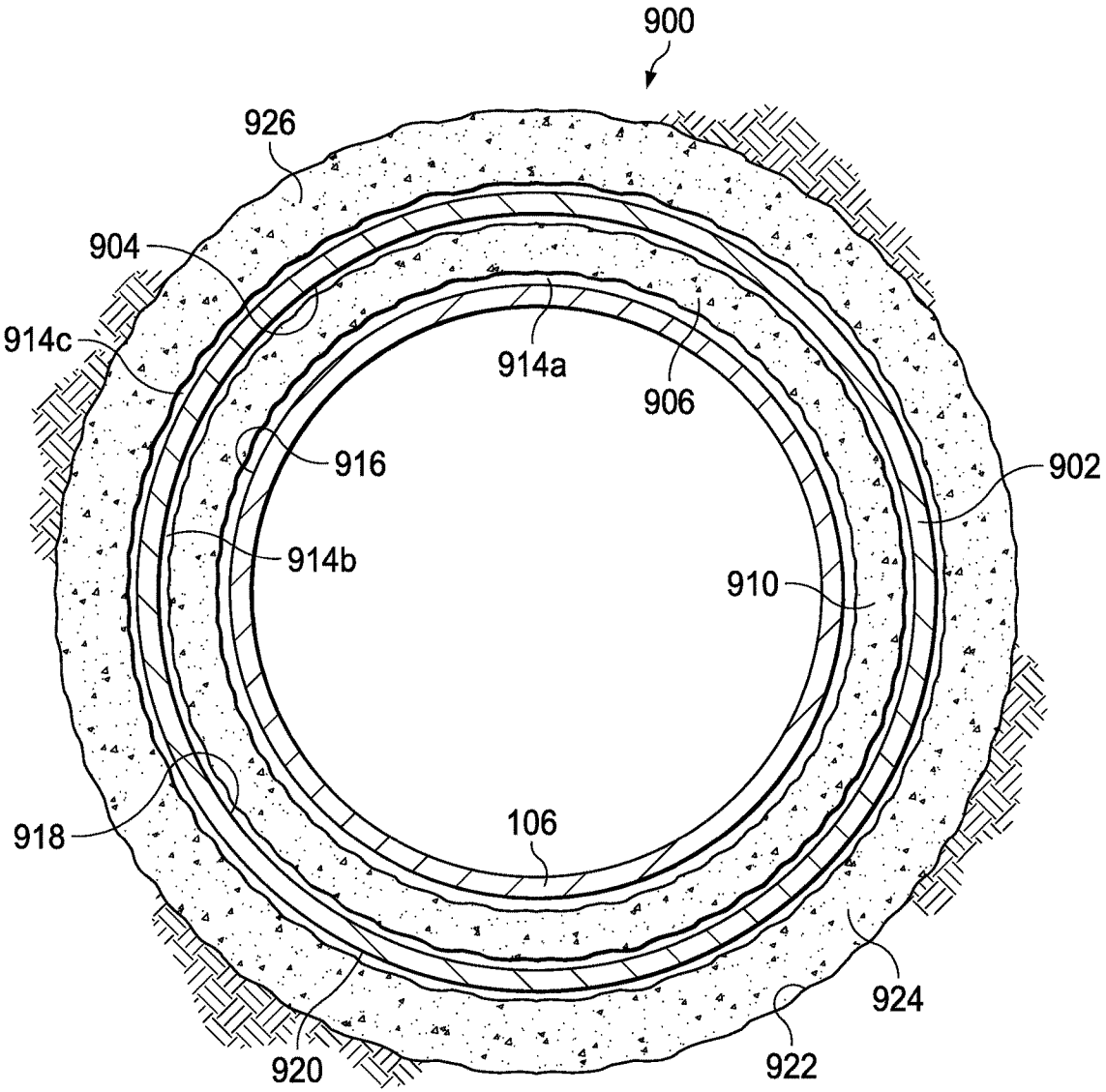
FIG. 4B is a schematic top view of the wellbore of FIG. 4A with cracked casing cement.
Figure 4A:
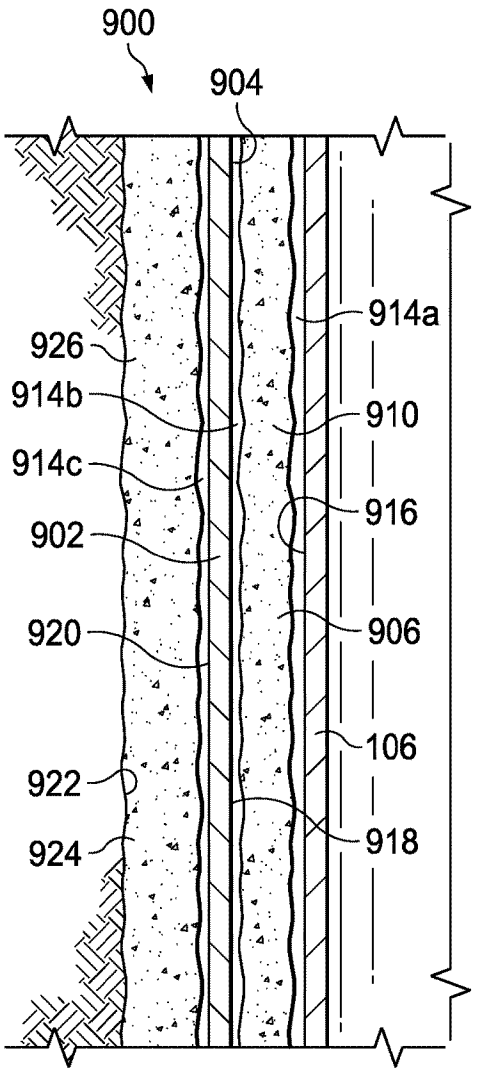
FIG. 4A is a schematic front view of another wellbore with cracked casing cement.

FIG. 4A is a schematic front view of another wellbore with cracked casing cement. FIG. 4B is a schematic top view of the wellbore of FIG. 4A with cracked casing cement. As shown in FIGS. 4A-4B, a wellbore 900 generally similar to the wellbore 100 can include a second casing 902 positioned around the casing 106. The second casing 902 (the outer tubular) is disposed within the wellbore 900 first, and the casing 106 (the inner tubular) is then disposed within the second casing 902 (the outer tubular) to seal the wellbore 900. The second casing is substantially similar to the casing 106. The outer surface of the casing 106 and an inner surface 904 of the second casing 902 define a first annulus 906. The first annulus 906 can be filled with a first cement 910. The first cement 910 can have multiple sets of cracks. A first set of cracks 914*a* can be on an outside surface 916 of the casing 106. A second set of cracks 914*b* can be on an inside surface 918 of the second casing 902. An outer surface 920 of the second casing 902 and an inner surface 922 of the wellbore 900 define a second annulus 924. The second annulus 924 can be filled with a second cement 926. The second cement 926 can have a third set of cracks 914*c*. The cracked first cement 910 and the cracked second cement 926 may no longer seals a wellbore 900.

Figure 5B:
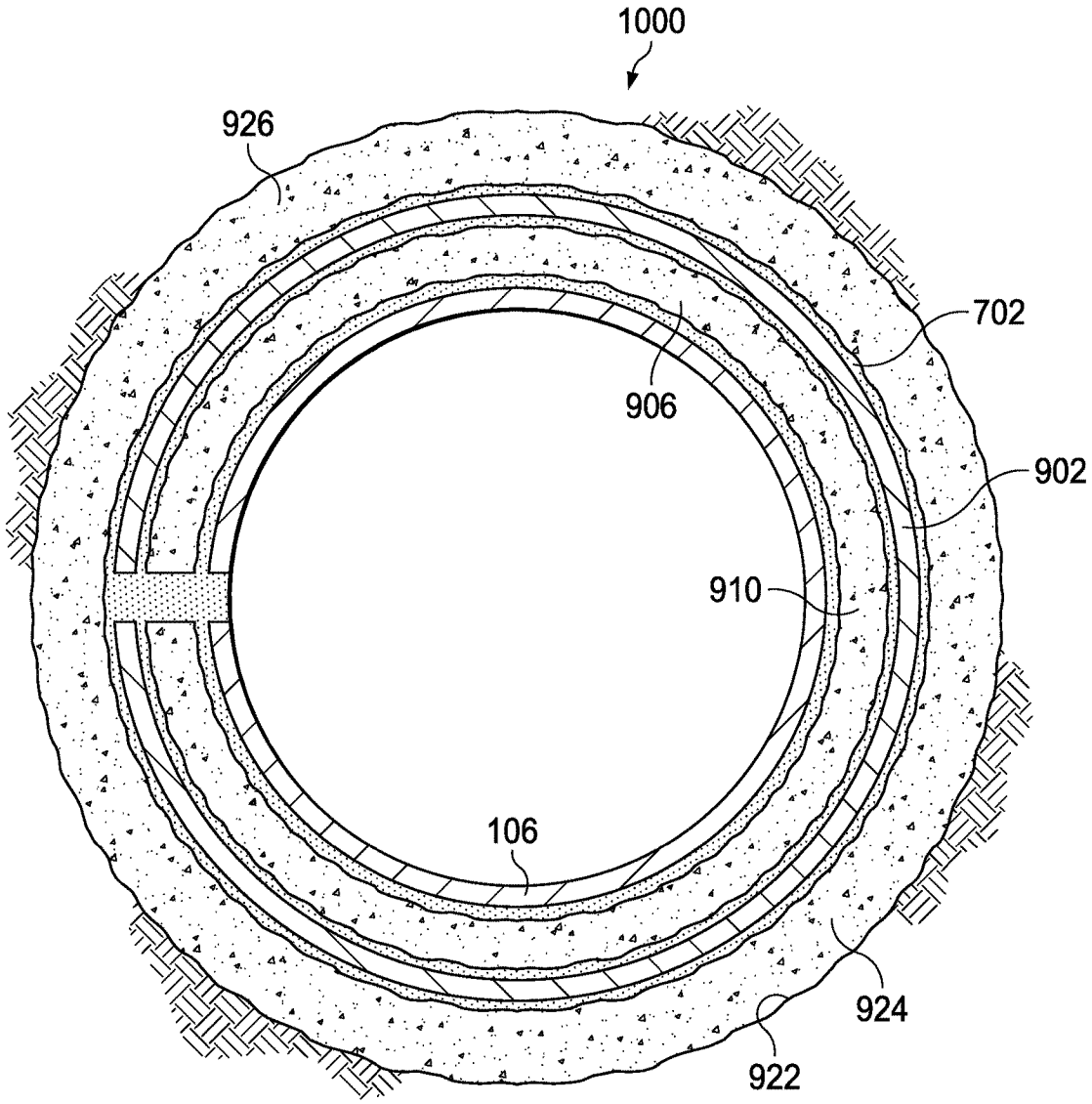
FIG. 5B is a schematic top view of the wellbore of FIG. 4A with the cracked casing cement sealed.
Figure 5A:
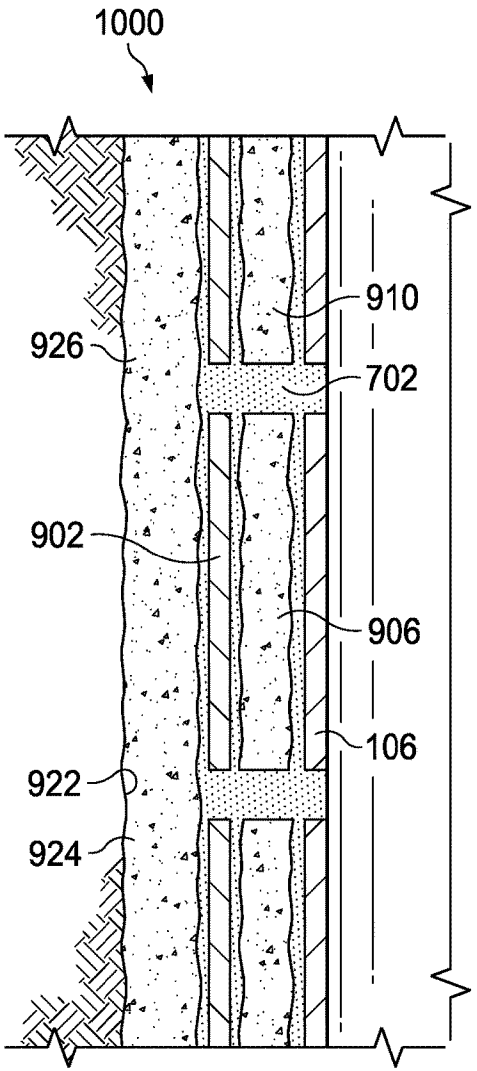
FIG. 5A is a schematic front view of the wellbore of FIG. 4A with the cracked casing cement sealed.

In some cases, as described earlier and shown in FIGS. 4A-4B, the crack network 538 can extend through the casing 106, the first cement 910, the second casing 902, and the second cement 926 and includes the first set of cracks 914*a*, the second set of cracks 914*b*, and the third set of cracks 914*c*. FIG. 5A is a schematic front view of the wellbore of FIG. 4A with the cracked casing cement sealed. FIG. 5B is a schematic top view of the wellbore of FIG. 4A with the cracked casing cement sealed. As shown in FIGS. 5A-5B, a sealed wellbore 1000. The sealant 604 can flow into the crack network 538 (of FIGS. 4A-4B) to seal the first set of cracks 914*a*, the second set of cracks 914*b*, and the third set of cracks 914*c* to create the sealed crack network 702.

A method to seal a single annulus in a single casing has been shown. In a wellbore in which multiple casings, for example, a first casing and a second casing defining multiple annuli, are deployed as previously described in FIGS. 4A-4B, the multiple annuli can be sealed. The first casing and the wellbore define a first annulus sealed with a first casing cement. The second casing and the first casing define a second annulus sealed with a second casing cement. Either a first portion of the first casing cement or a second portion of the second casing cement, both the first casing cement and the second casing cement, just the first casing cement, or just the second casing cement adjacent to either a first outer wall of the first casing or a second outer wall of the second casing is vibrated. The first portion of the first casing cement or a second portion of the second casing cement include multiple discrete cracks. Vibrating the first casing cement and/or the second casing cement connects the discrete cracks to form a first crack network and/or a second crack network. The first casing cement and/or the second casing cement can be in direct contact with the first outer wall of the first casing or the second outer wall of the second casing.

Vibrating the first portion of the first casing cement and/or the second portion of the second casing cement can include applying a vibration to a first inner wall of the first casing adjacent the first portion of the first casing cement and/or to a second inner wall of the second casing adjacent the second portion of the second casing cement. The second inner wall of the second adjacent casing can be accessed by first perforating the casing 106 and cement 112 as previously described. The first casing and the second casing each transmit the vibration to the first portion of the first casing cement and the second portion of the second casing cement, respectively. A contact frequency and a contact force can be determined to repetitively vibrate the first casing and the second casing at the contact frequency and the contact force. The contact frequency and the contact force enlarge and connect the discrete cracks to create the first crack network and the second crack network.

An impactor can impact the casing to vibrate the first portion of the first casing cement in the first annulus and pass through the perforations to impact the second portion of the second casing cement in the second annulus. Vibrating the first portion of the first casing cement in the first annulus and the second portion of the second casing cement in the second annulus can create a vibration in a vicinity of the first casing and the second casing where a vibration tool contacts the second casing. The impactor can mechanically impact the second casing. The impactor can fluidically impact the second casing.

Prior to injecting the sealant into the first crack network and the second crack network, the first casing and the second crack network are perforated to remove a first portion of the first casing and a second portion of the second casing to fluidically couple the hollow casing to the first crack network and the second crack network. A perforation tool can perforate the first casing with to create a first perforated portion and the second casing to create a second perforated portion. The perforation tool is a mechanical drilling tool that can mechanically drill a side hole into the casing and the cement behind the casing. These perforation tool can be hydraulically or electrically powered. In some cases, as described earlier and shown in FIGS. 4A-4B, the perforation tool 502 perforates the casing 106, the first cement 910, the second casing 902, and the second cement 926. Perforating the casing 106, the first cement 910, the second casing 902, and the second cement 926 creates the crack network 538 from the first set of cracks 914*a*, the second set of cracks 914*b*, and the third set of cracks 914*c*.

After vibrating the first casing cement to form the first crack network and the second casing cement to form the second crack network, a sealant is injected into the first crack network through the first casing and the second crack network through the second casing. The sealant seals the first crack network and the second crack network. The sealing tool can be fluidically coupled to the first crack network through the first perforated portion of the first casing and to the second crack network through the second perforated portion of the second casing. The sealing tool injects the sealant into the first crack network and the second crack network. The sealant flows through the sealing tool. The sealant injected into the first crack network and the second crack network to create a sealed crack network. The sealing tool is then fluidically decoupling from the sealed crack network.

After injecting the sealant into the first crack network and the second crack network, the second casing can be patched to further seal the crack network. A patch can be attached to an inner wall of the second casing adjacent to the crack network to seal the crack network.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A method comprising:

in a wellbore in which a casing is deployed, the casing and the wellbore defining an annulus sealed with a casing cement:

vibrating a portion of the casing cement adjacent an outer wall of the casing, wherein the portion of the casing cement comprises a plurality of discrete cracks, wherein vibrating the casing cement connects the plurality of discrete cracks to form a crack network;

after vibrating the casing cement to form the crack network, injecting a sealant into the crack network through the casing, the sealant configured to seal the crack network; and after injecting the sealant into the crack network, patching the casing to further seal the crack network.

2. The method of claim 1, wherein the portion of the casing cement adjacent the outer wall of the casing comprises the casing cement in direct contact with the outer wall of the casing.

3. The method of claim 1, wherein vibrating the portion of the casing cement comprises applying a vibration to an inner wall of the casing adjacent the portion of the casing cement, wherein the casing transmits the vibration to the portion of the casing cement.

4. The method of claim 3, wherein applying the vibration comprises determining a contact frequency and a contact force to repetitively vibrate the casing at the contact frequency and the contact force, wherein the contact frequency and the contact force enlarge and connect the plurality of discrete cracks to create the crack network.

5. The method of claim 1, wherein vibrating the portion of the casing cement comprises impacting the casing with an impactor vibrates the portion of the casing cement in the annulus.

6. The method of claim 5, wherein vibrating the portion of the casing cement in the annulus creates vibration in a vicinity of the casing where a vibration tool contacts the casing.

7. The method of claim 5, wherein impacting the casing with the impactor comprises mechanically impacting the casing with the impactor.

8. The method of claim 5, wherein impacting the casing with the impactor comprises fluidically impacting the casing with the impactor.

9. The method of claim 1, further comprising, prior to injecting the sealant into the crack network, perforating the casing with a perforation tool to remove a portion of the casing to fluidically couple the casing to the crack network.

10. The method of claim 9, wherein injecting the sealant comprises:

fluidically coupling a sealing tool to the crack network through the casing, the sealing tool configured to inject the sealant into the crack network;

flowing the sealant through the sealing tool;

injecting the sealant into the crack network to create a sealed crack network; and fluidically decoupling the sealing tool from the sealed crack network.

11. The method of claim 1, wherein patching the casing comprises attaching a patch to an inner wall of the casing adjacent to the crack network to seal the crack network.

12. A wellbore tool comprising:

a vibration sub-assembly comprising a first vibration head configured to repetitively contact a casing of a wellbore, the casing and the wellbore defining an annulus sealed with a casing cement, wherein a portion of the casing cement adjacent an outer wall of the casing comprises a plurality of discrete cracks;

a vibration drive operatively coupled to the vibration sub-assembly configured to operate the first vibration head to create vibration in a portion of the casing and a vicinity of the casing where the first vibration head contacts the casing;

a tool body configured to accept the vibration sub-assembly and the vibration drive, the tool body configured to be disposed in the wellbore, the tool body comprising a first opening to pass the first vibration head through the first opening to repetitively contact the casing; and an anchor mechanically coupled to the tool body to engage the tool body to the casing.

13. The wellbore tool of claim 12, wherein the anchor is disposed within the tool body, and wherein the tool body comprises a second opening to pass the anchor through the second opening to engage the tool body to the casing.

14. The wellbore tool of claim 12, wherein the vibration drive further comprises a power source to supply power to the vibration sub-assembly.

15. The wellbore tool of claim 12, wherein the vibration drive is configured to operate the first vibration head to repetitively contact the casing at a contact frequency and a contact force.

16. The wellbore tool of claim 12, wherein the vibration sub-assembly further comprises a second vibration head, and wherein the tool body further comprises a third opening to pass the second vibration head through a third opening to repetitively contact the casing.

17. The wellbore tool of claim 16, wherein the vibration drive further comprises a wedge operatively coupled to the first vibration head and the second vibration head, the wedge configured to move the first vibration head and the second vibration head to contact the casing.

18. The wellbore tool of claim 17, wherein the vibration drive further comprises a plurality of springs operatively coupled to the first vibration head and the second vibration head, the plurality of springs configured to move the first vibration head and the second vibration head out of contact with the casing.

* * * * *